US007789526B2

(12) United States Patent
Gibbons et al.

(10) Patent No.: US 7,789,526 B2
(45) Date of Patent: Sep. 7, 2010

(54) QUICK DISCONNECT LIGHTING SYSTEM

(75) Inventors: John K. Gibbons, St. James, NY (US); David P. Eckel, Northport, NY (US); Christopher Montalbano, Huntington, NY (US); Gregory Montalbano, Huntington, NY (US); Aaron Klein, Brightwaters, NY (US)

(73) Assignee: B/E Aerospace, Inc., Wellington, FL (US)

( * ) Notice: Subject to any disclaimer, the term of this patent is extended or adjusted under 35 U.S.C. 154(b) by 78 days.

(21) Appl. No.: 12/144,009

(22) Filed: Jun. 23, 2008

(65) Prior Publication Data

US 2009/0316437 A1 Dec. 24, 2009

(51) Int. Cl.
*F21V 4/04* (2006.01)

(52) U.S. Cl. ..... 362/198; 362/249.08; 362/134; 362/189

(58) Field of Classification Search ..... 362/189, 362/198, 249.04, 249.08, 278, 470, 472, 362/132, 134
See application file for complete search history.

(56) References Cited

U.S. PATENT DOCUMENTS

| | | | | |
|---|---|---|---|---|
| 2005/0185398 | A1 * | 8/2005 | Scannell | 362/227 |
| 2005/0195600 | A1 * | 9/2005 | Porchia et al. | 362/240 |
| 2005/0225971 | A1 * | 10/2005 | Melnik | 362/202 |
| 2006/0012980 | A1 * | 1/2006 | Mize | 362/198 |
| 2006/0083009 | A1 * | 4/2006 | Hsu | 362/396 |

* cited by examiner

*Primary Examiner*—Jong-Suk (James) Lee
*Assistant Examiner*—Julie A Shallenberger
(74) *Attorney, Agent, or Firm*—Drinker Biddle & Reath LLP

(57) ABSTRACT

A lighting system that includes a quick disconnect mounting feature that permits the relocation of the lighting fixture without rewiring or use of loose hardware. The lighting system is comprised of a housing that surrounds a power module and a control module, where the control module is electrically connected to a protocol module. A printed circuit board interface electrically connects the power module to the control module, and a light source is electrically connected to the PCB interface.

9 Claims, 15 Drawing Sheets

QUICK DISCONNECT LIGHTING SYSTEM

FIELD OF THE INVENTION

This invention pertains to a lighting system and, more particularly, to a modular lighting system having a quick disconnect feature.

BACKGROUND OF THE INVENTION

Lighting fixtures used for illumination as well as for reading or spot lighting are well known in the art. In order to allow for installation, conversion, upgrading, removal and servicing, known designs of lighting systems that are used for individual reading lights depend on specialized plates, loose hardware, and access to the backside of the panel to which the lighting fixture is attached. Currently, these individual lighting systems, which are intended to routinely be moved or removed for servicing or use, are installed using visible hardware such as screws, while a pendant wire harness is used to facilitate electrical connections. Although quite functional, visible screw heads do not provide a clean sleek look.

Conventional lighting systems also often require a separate electrical drive circuit. This drive circuit also depends on loose hardware as well as access to the backside of the panel to facilitate installation. Furthermore, a pendant wire harness with a locking type connector requires the use of two hands to connect or disconnect the halves of the connector. These existing designs, which may be located on, for example, vehicle seats or institutional beds, do not allow the lighting fixture to be moved between locations, or removed for repair or replacement, without partial disassembly of the lighting fixture or the panel to which it is mounted. It is for these reasons that a lighting system that includes a quick interface disconnect from a power module would be an important improvement in the art.

BRIEF SUMMARY OF THE INVENTION

The invention involves a lighting system that is comprised of a housing that surrounds a power module and a control module, where the control module is electrically connected to a protocol module. Although ideally separate, the functionality of the control module, power module and protocol module may also be combined into one module comprising the functionality of all three. A printed circuit board ("PCB") interface electrically connects the power module to the control module. In the case where the modules are combined into one, the interface PCB may not be required. A light fixture is electrically connected to the PCB interface, and a light source is electrically connected to the light fixture.

DETAILED DESCRIPTION OF THE INVENTION

Figure 1:
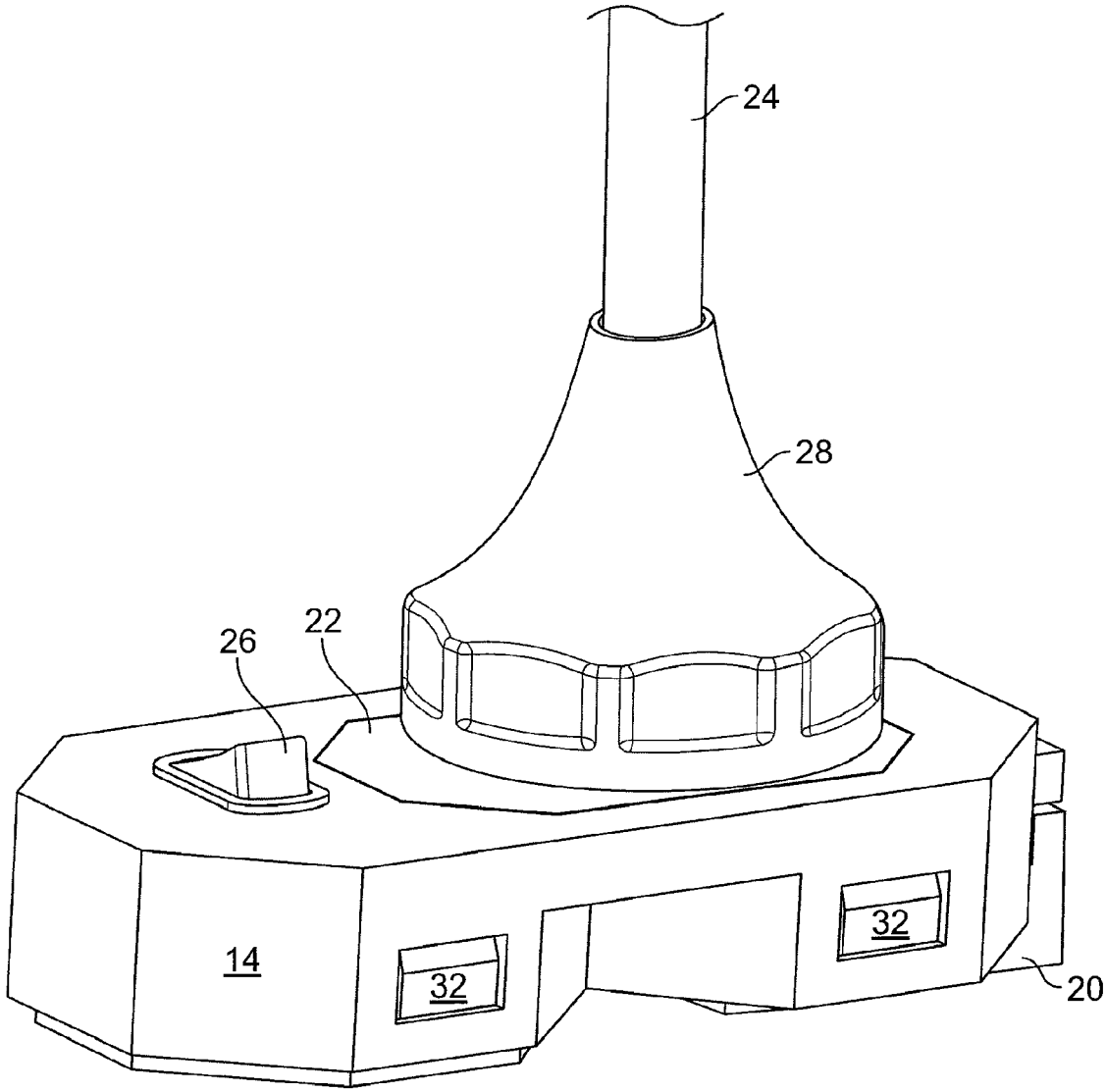
FIG. 1 is a perspective view of the quick disconnect lighting module.
Figure 2:
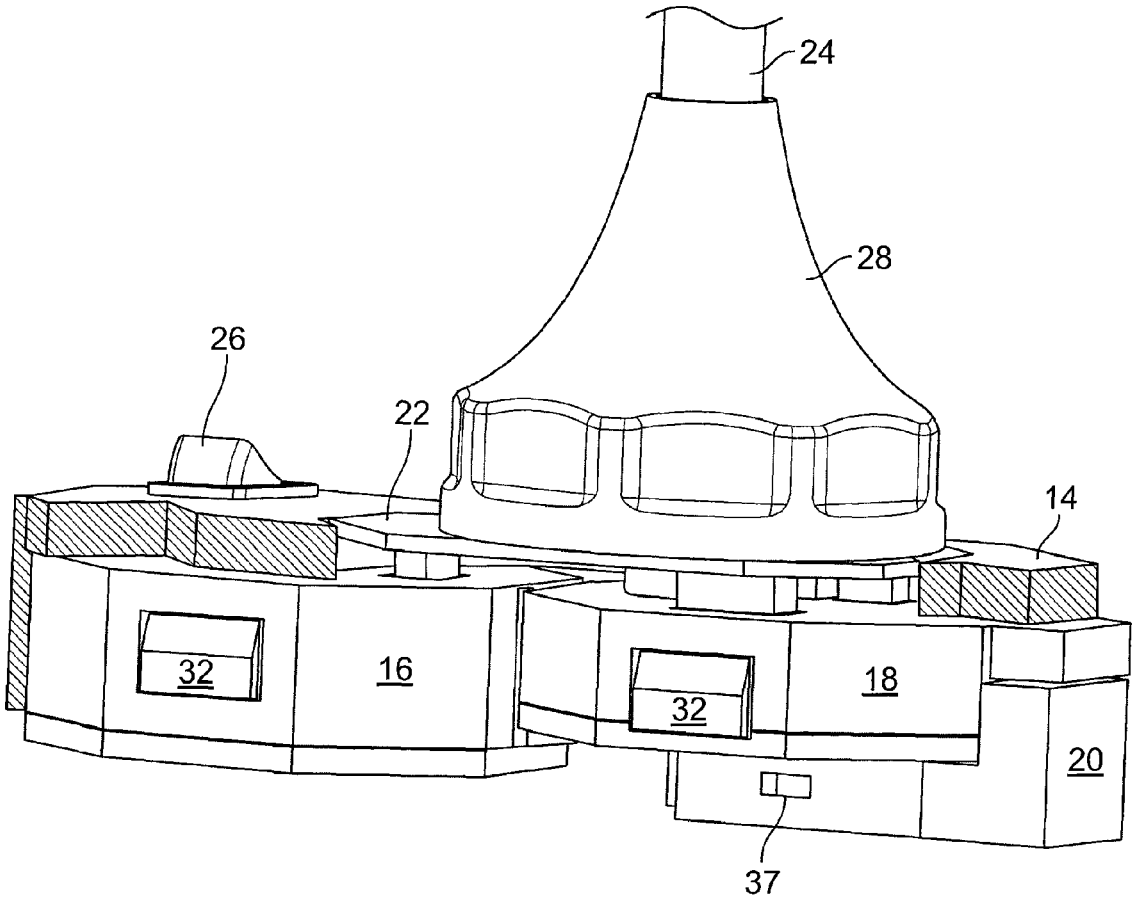
FIG. 2 is a sectional view of the quick disconnect lighting module showing the protocol module, the power module, and the control module.

The invention involves a lighting system 10 that is used for reading or spot illuminating applications, specifically the invention involves a lighting fixture 24 that includes a quick disconnect mounting feature that permits the relocation of the lighting fixture 24 without rewiring or use of loose hardware.

As shown in FIGS. 1-9, the lighting system 10 is comprised of a housing 14 that surrounds a power module 16 and a control module 18, where the control module 18 is electrically connected to a protocol module 20. A PCB interface 22 electrically connects the power module 16 to the control module 18, a light fixture 24 is electrically connected to the PCB interface 22, and a light source 25 is electrically connected to the light fixture 24. In an embodiment, a switch mechanism 26 is electrically connected to the power module 16.

The housing 14 containing the power, control, and protocol modules 16, 18, 20 may be positioned within a furniture cabinet or placed on top of a table or cabinet. In some cases, the power, control and protocol modules may be combined into one module. The housing 14 may also be enclosed in a furnishing so that it is only accessible through a movable cover such as a hinged or sliding door or closure.

Figure 3:
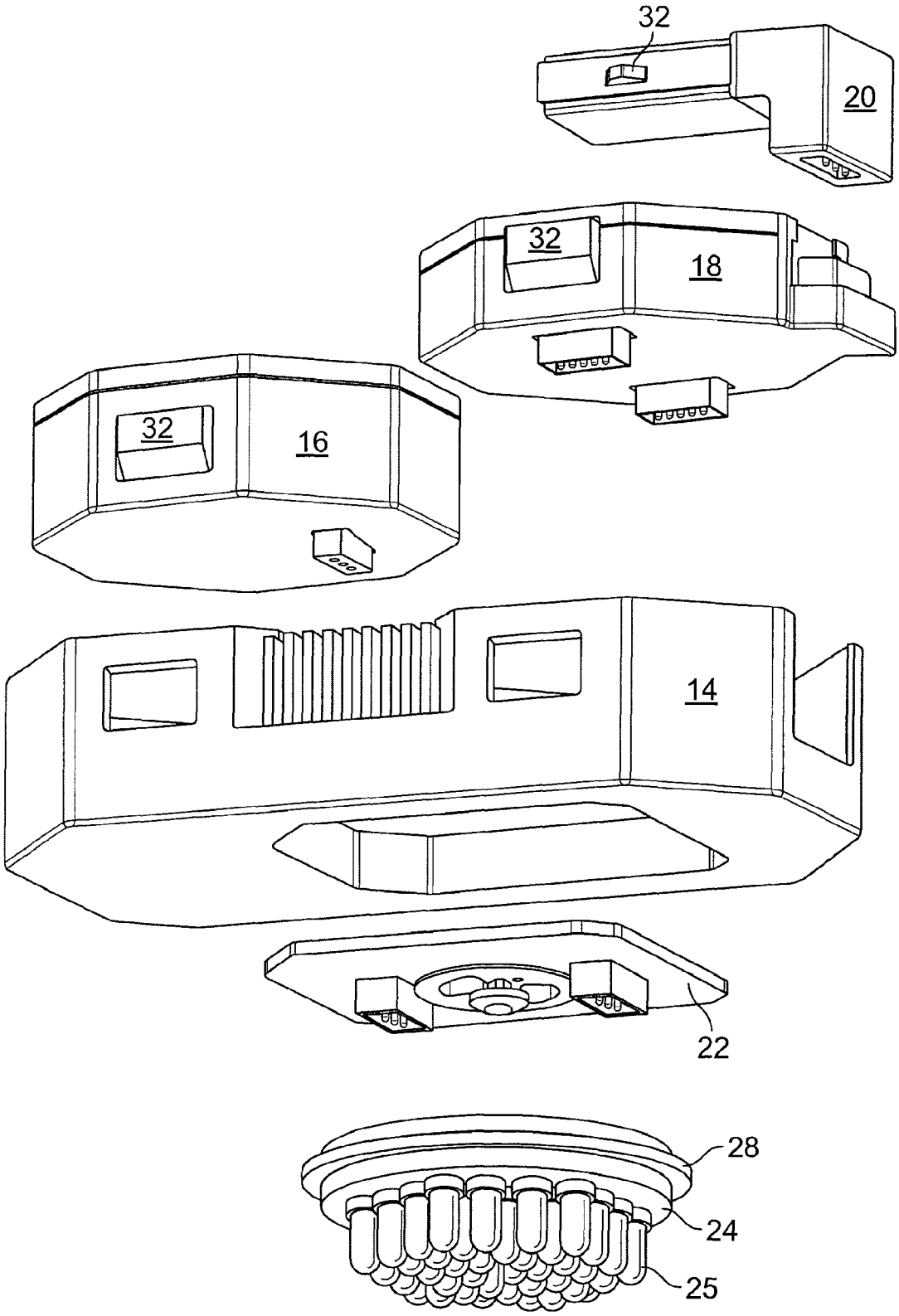
FIG. 3 is an exploded view of the quick disconnect housing showing the protocol module, control module, power module, housing PCB interface, lighting fixture, and a low profile light source.
Figure 4:
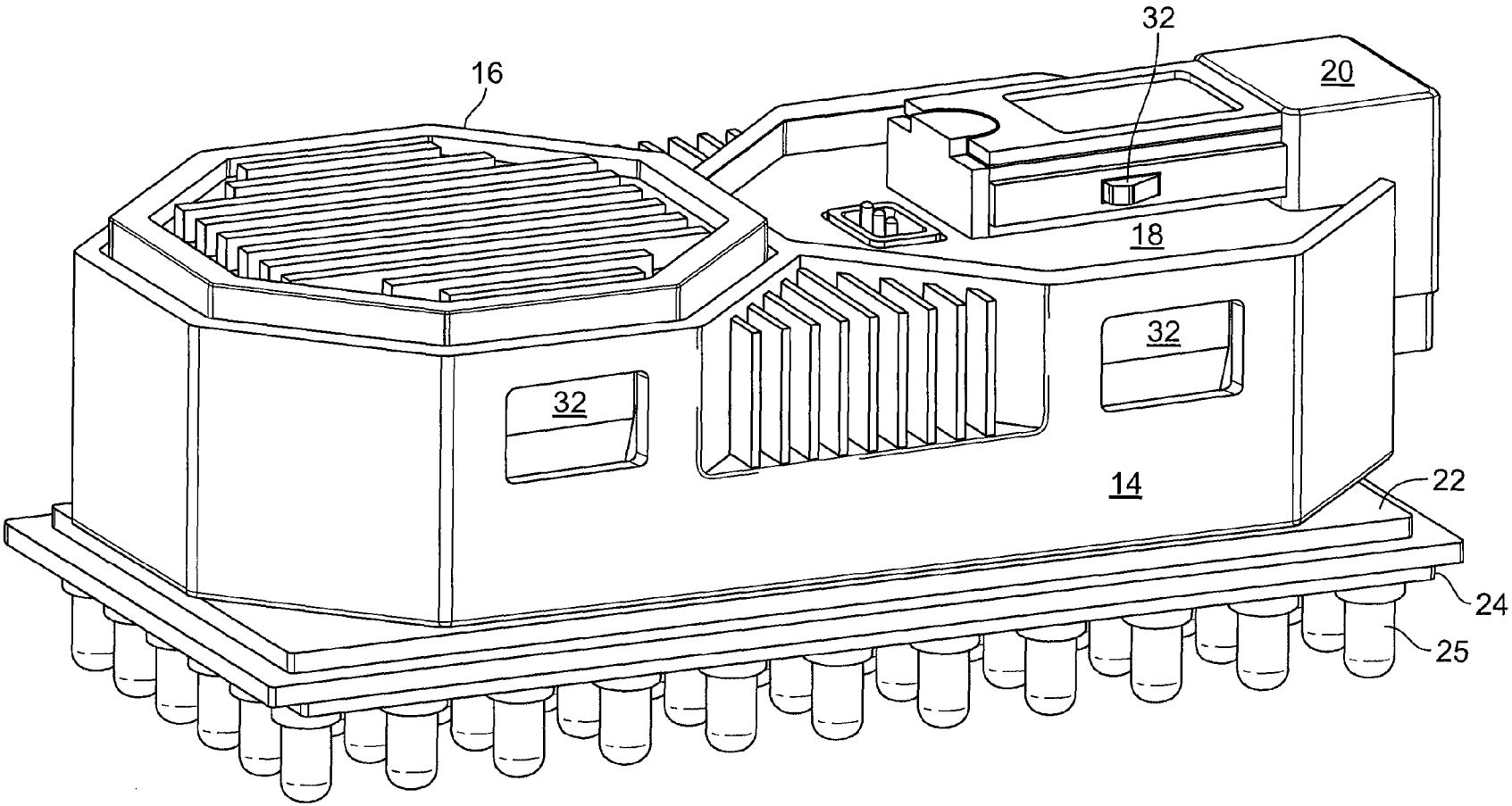
FIG. 4 is a perspective view of the quick disconnect module supporting a low profile light source.
Figure 5:
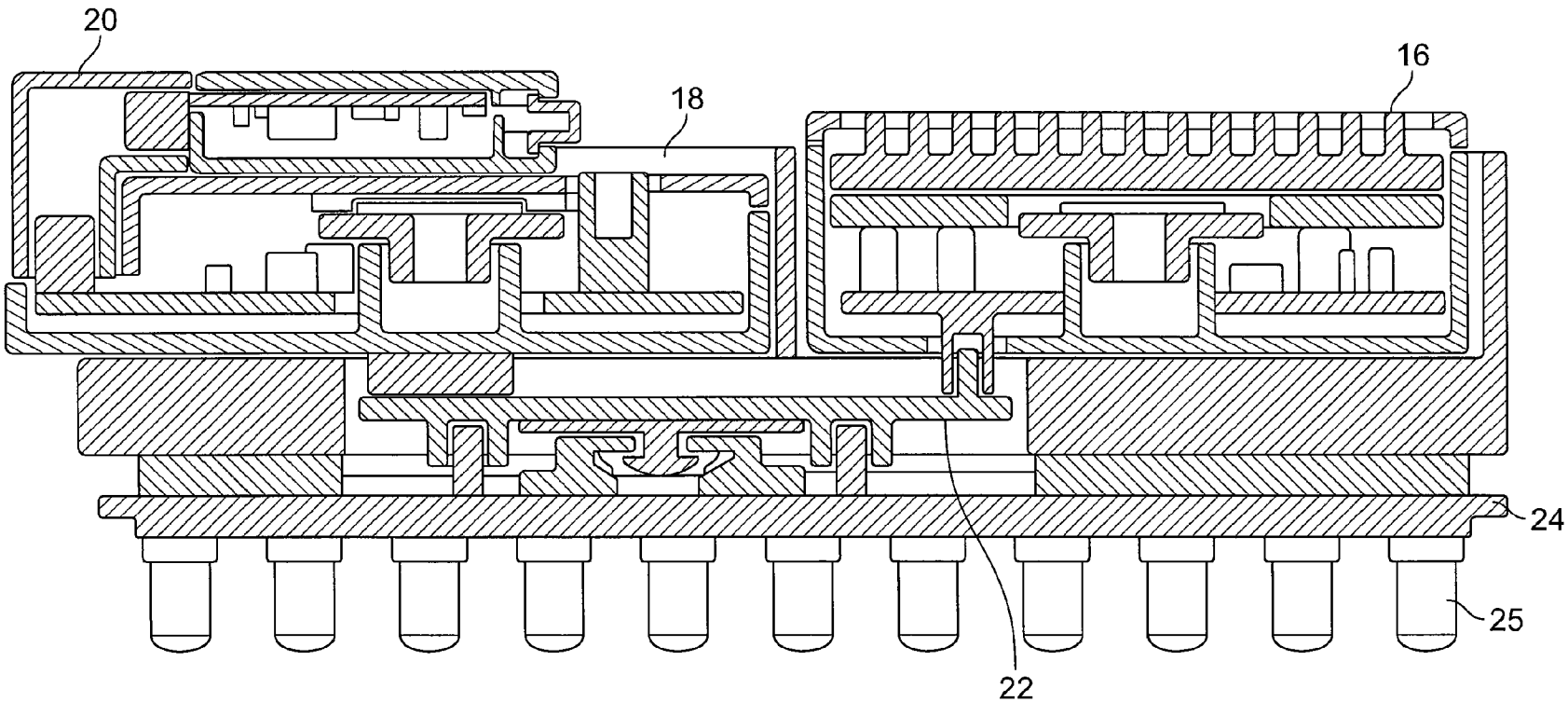
FIG. 5 is a sectional view of the quick disconnects module shown in FIG. 4.
Figure 6:
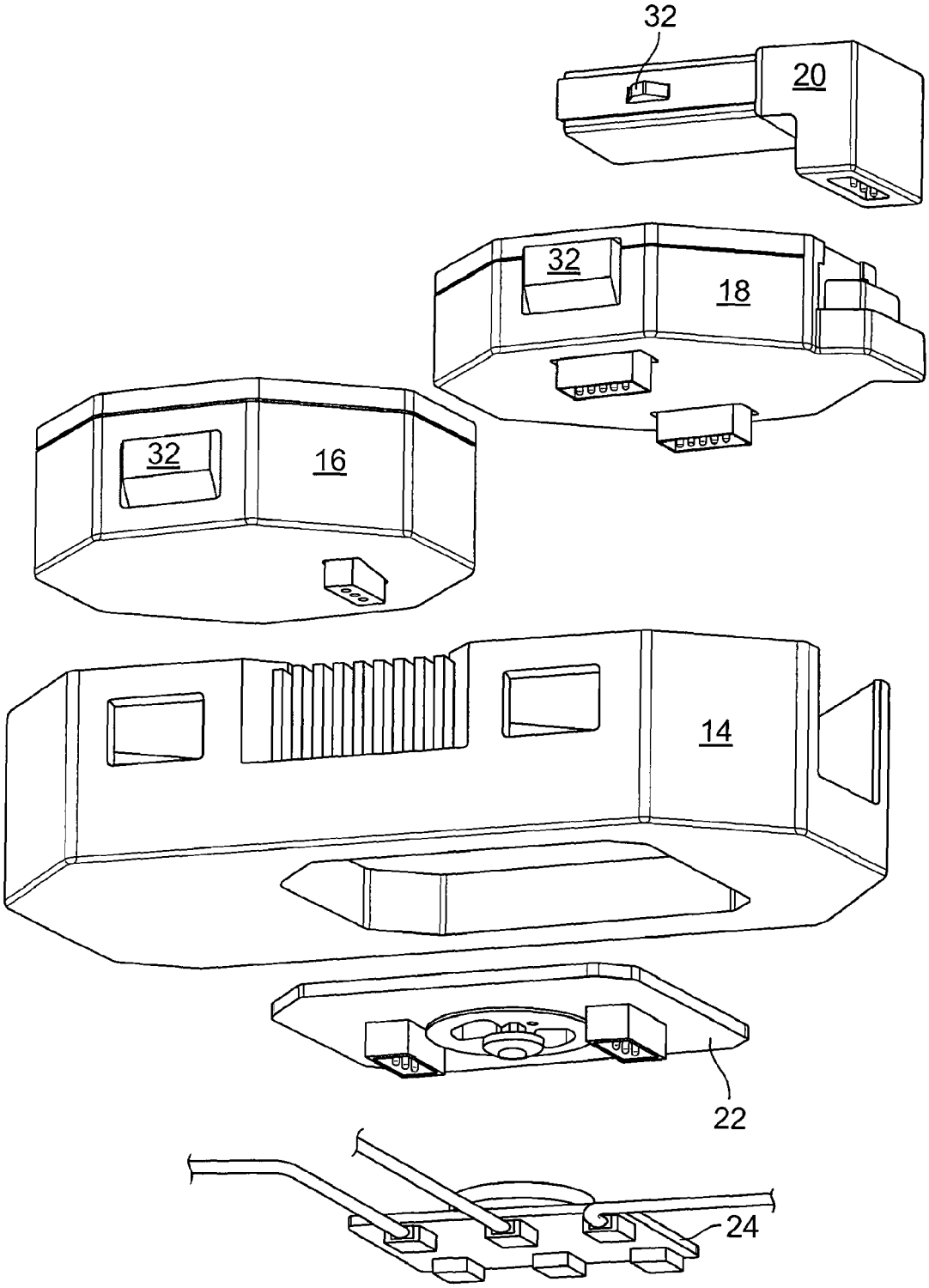
FIG. 6 is an exploded view of the quick disconnect module showing a light fixture capable of supporting a plurality of light sources.
Figure 7:
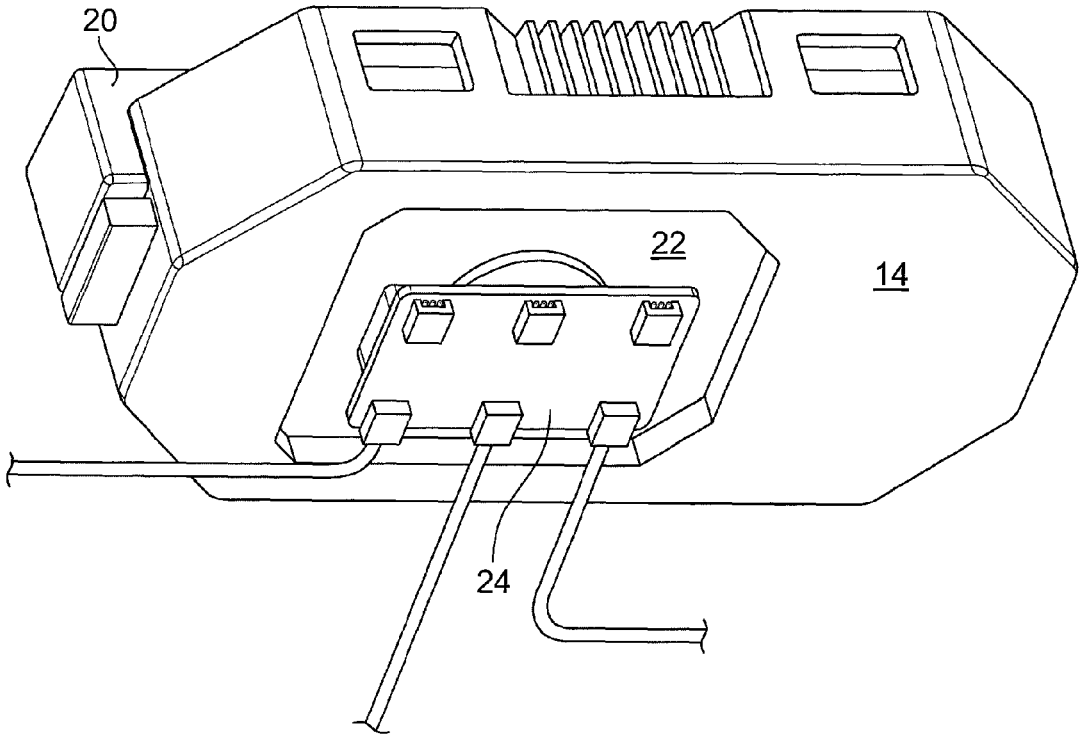
FIG. 7 is a perspective view of the quick disconnect module showing a light fixture capable of supporting a plurality of light sources attached to the PCB interface.

In an embodiment, as shown in FIGS. 8-12, 15, and 16, the light fixture 24 that is connected to the PCB interface 22 is a flexible reading lamp. As shown in FIGS. 3-5, in another embodiment, the light fixture 24 may support a low profile light source 25, while in still another embodiment; the light fixture 24 may support a plurality of light sources (not shown) that are electrically connected to the PCB interface 22, as shown in FIGS. 6 and 7.

Figure 8:
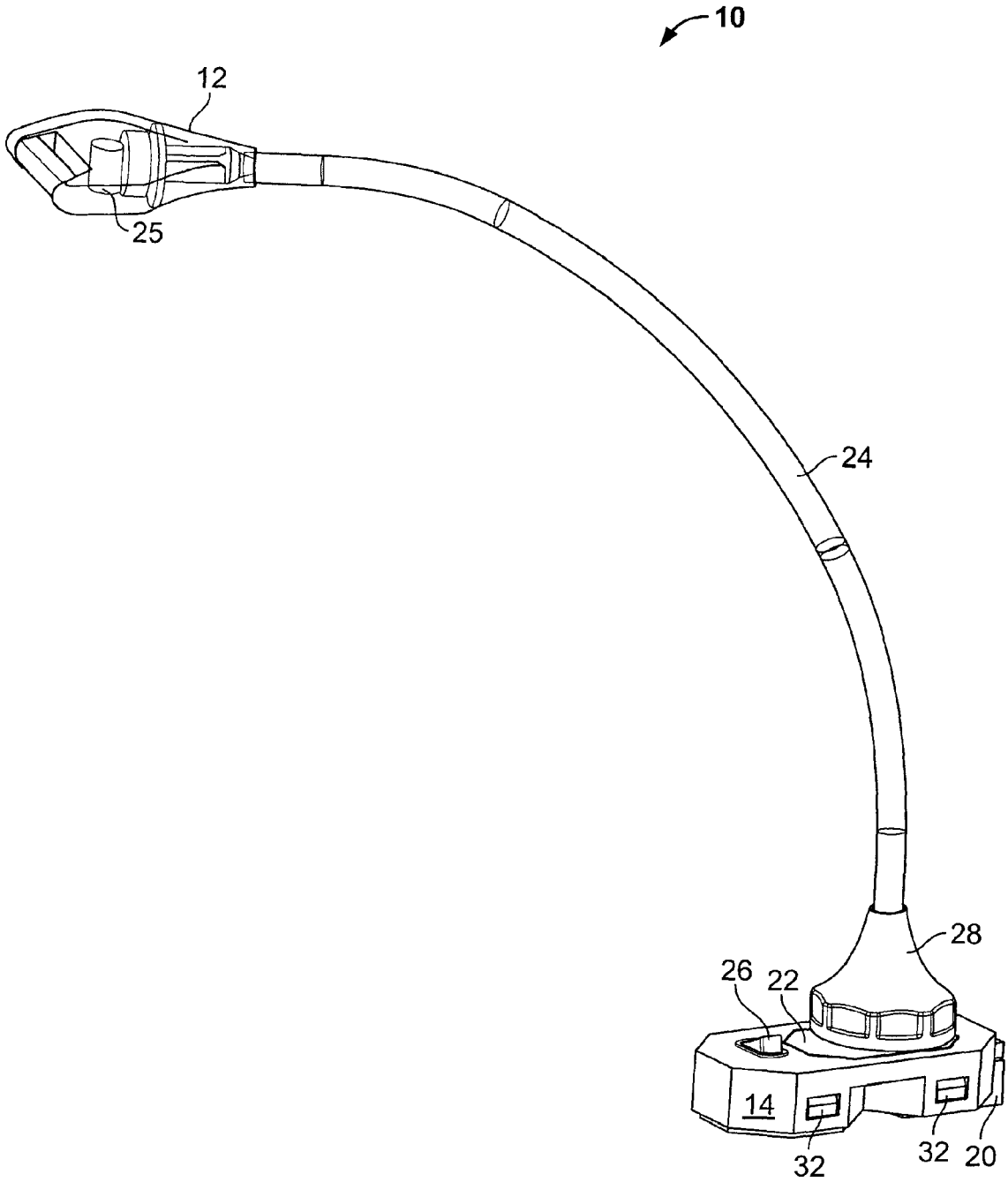
FIG. 8 is a perspective view of a flexible light fixture supporting a light source attached to the quick disconnect housing.
Figure 9:
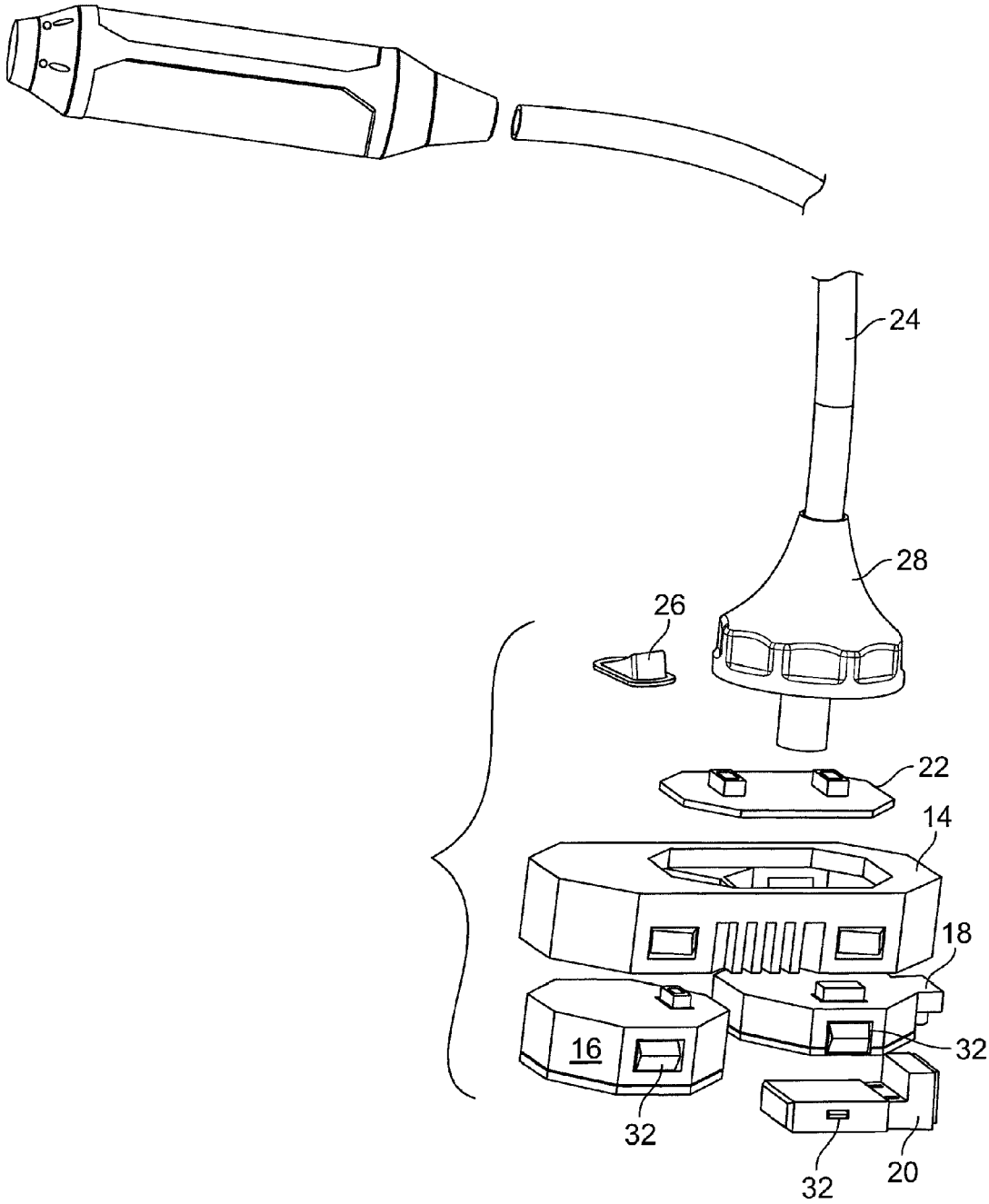
FIG. 9 is an exploded view of the quick disconnect housing and a flexible light fixture.
Figure 10:
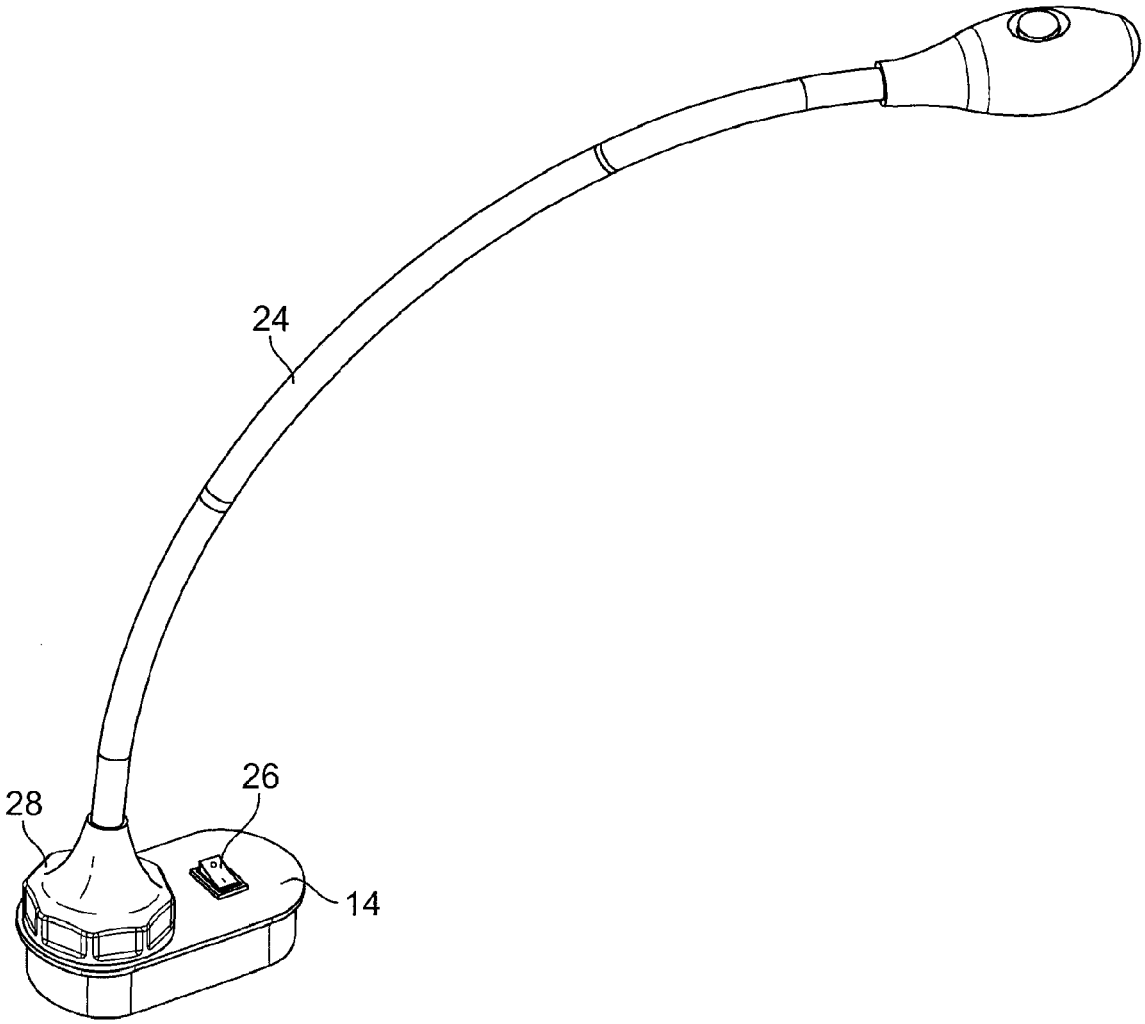
FIG. 10 is a perspective view of a flexible light fixture attached to a PCB interface.
Figure 11:
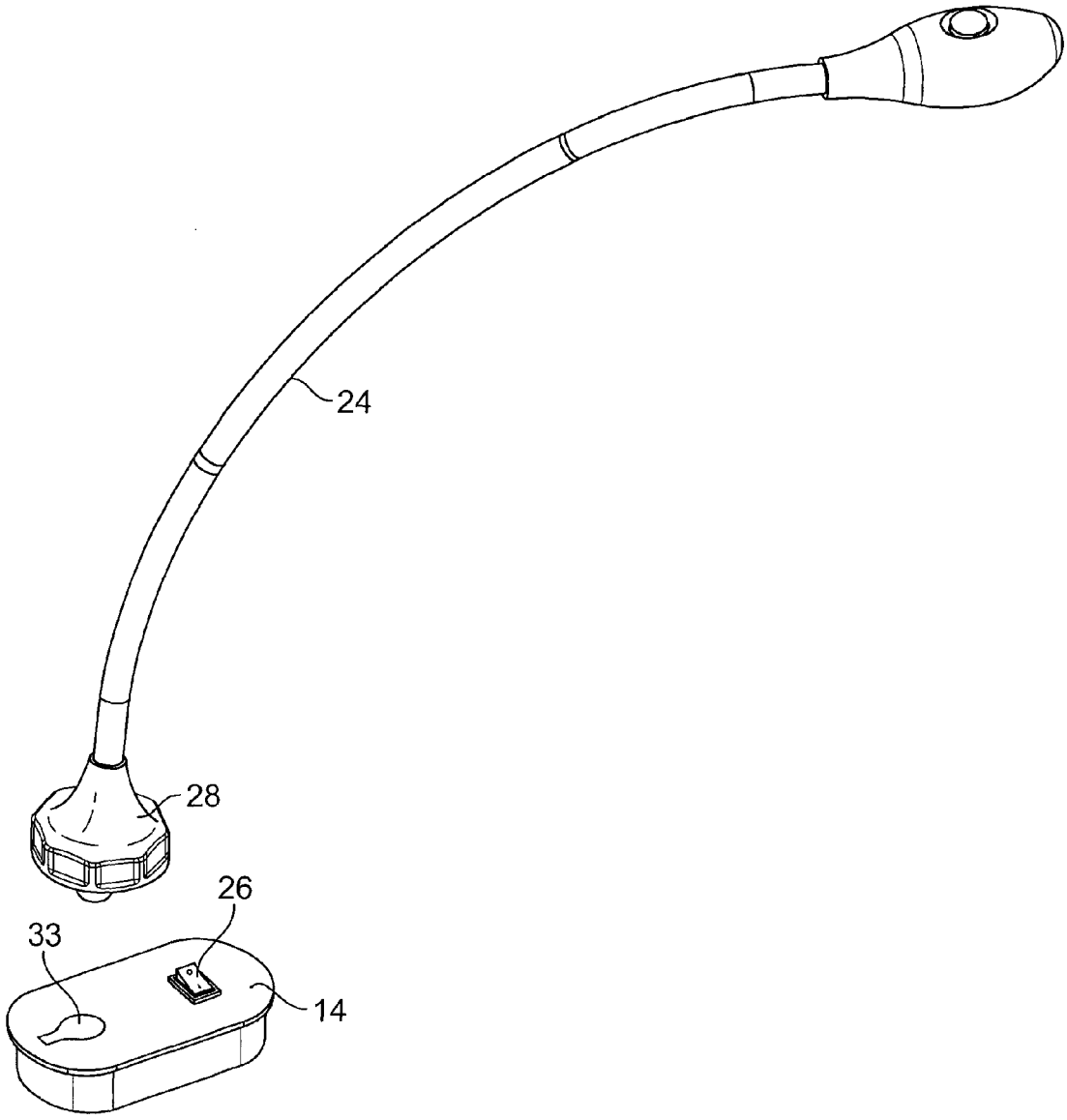
FIG. 11 is a perspective view of a flexible light fixture detached from a PCB interface.
Figure 12:
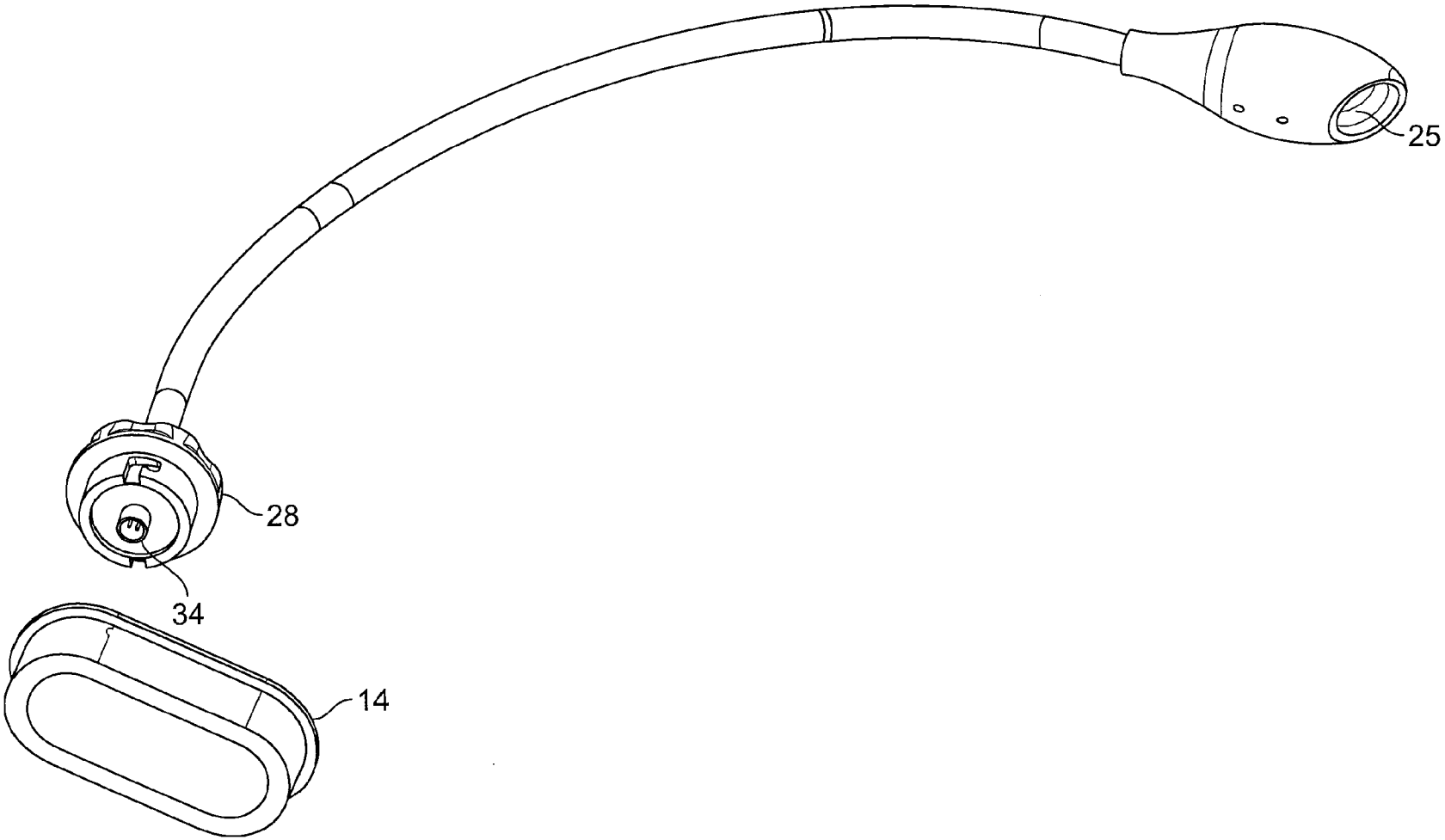
FIG. 12 is a perspective view of a flexible light fixture showing the attachment point in the collar of the fixture
Figure 14:
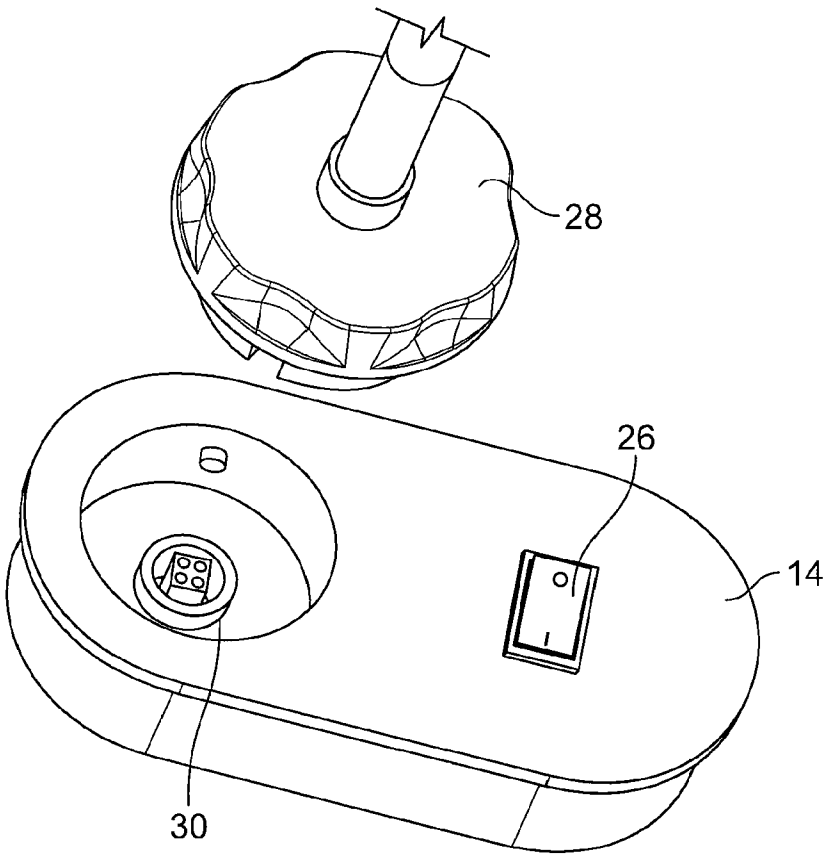
FIG. 14 is a perspective view showing the collar of the light fixture and the attachment receptacle in the PCB interface.
Figure 13:
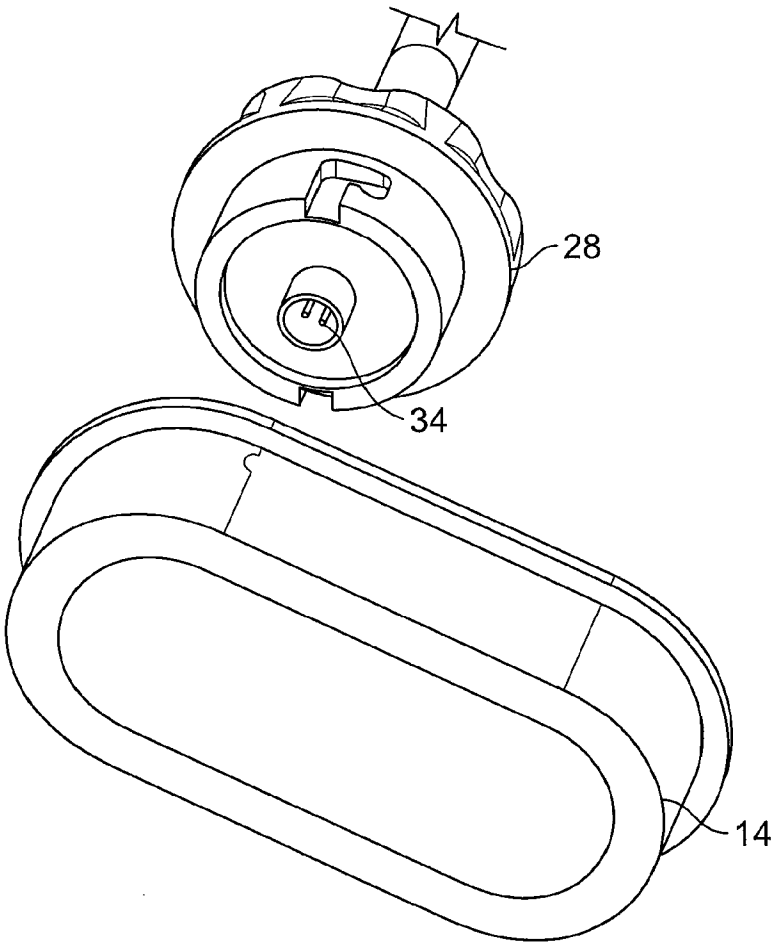
FIG. 13 is a perspective view showing the attachment point in the collar of the light fixture and the quick disconnect housing.
Figure 15:
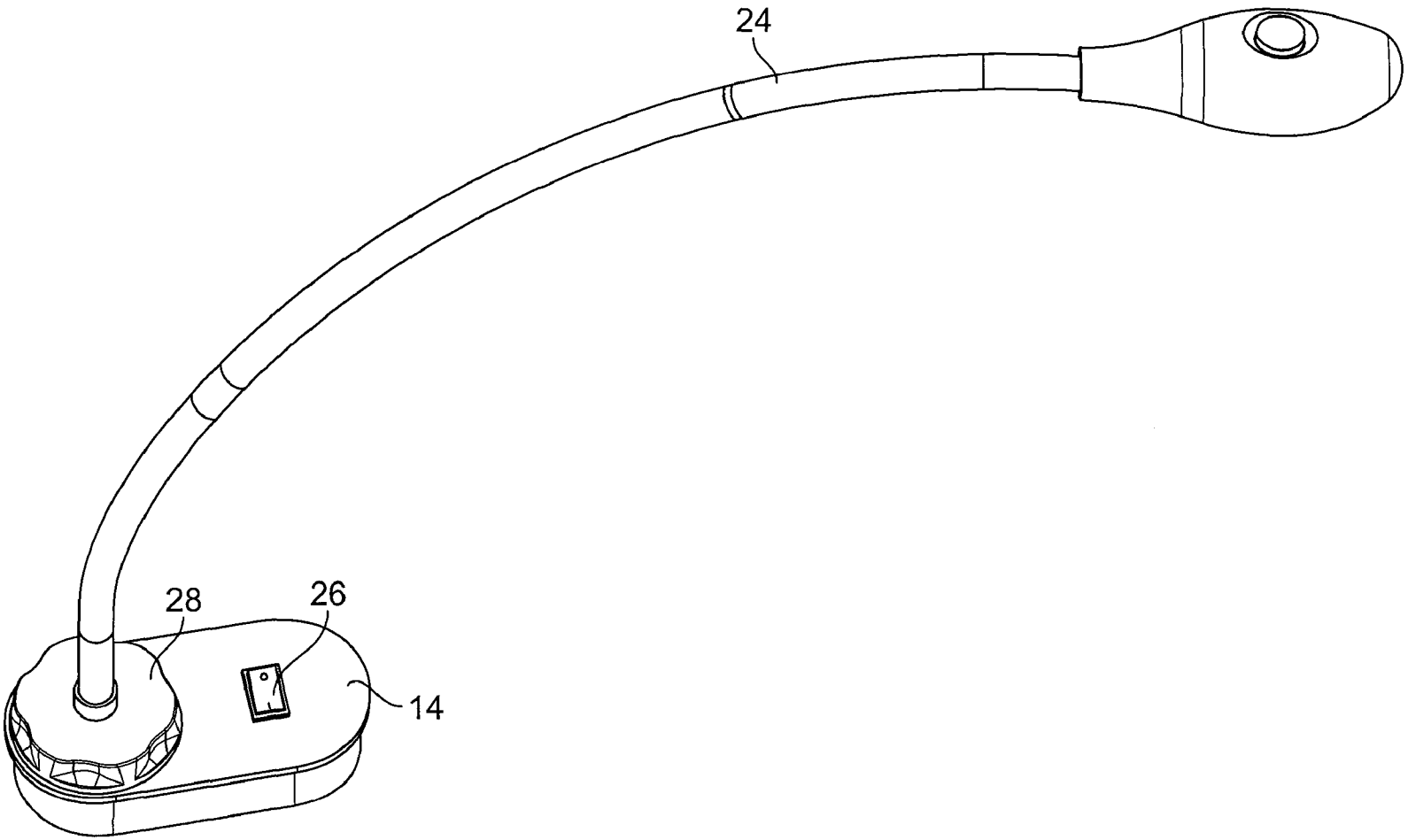
FIG. 15 is a perspective view showing a flexible light fixture attached to the quick disconnect housing.
Figure 16:
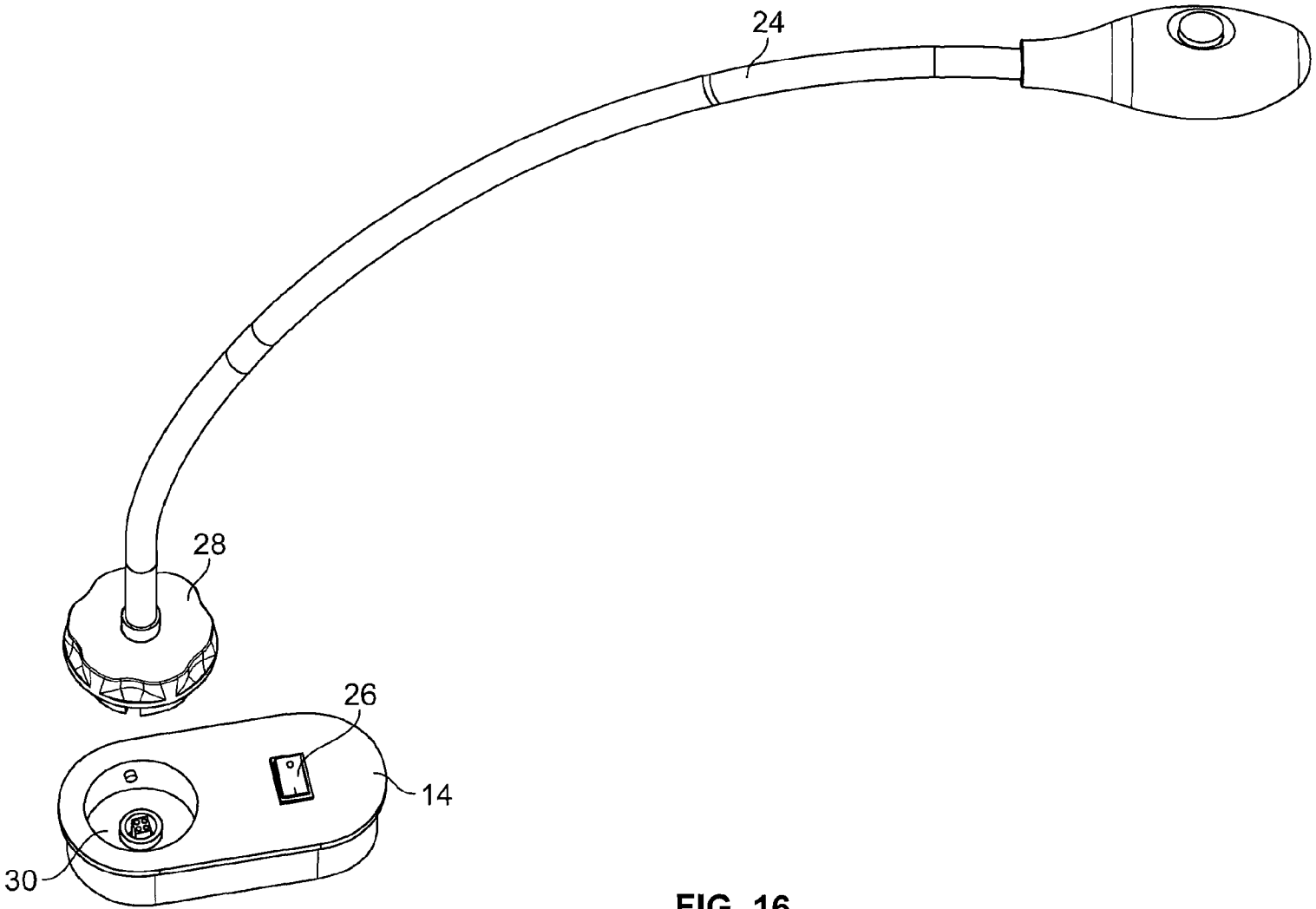
FIG. 16 is an exploded view showing the flexible light fixture detached from the quick disconnect housing.

In an embodiment, the light fixture 24 includes a collar 28, as shown in FIGS. 1, 2, and 8-16. When installed in the housing 14, the collar 28 provides the mechanical connection and seal between the lighting fixture 24 and its connection receptacle 30 in the PCB interface 22 located in the housing 14, as shown in FIGS. 14 and 16. The receptacle 30 has a self-stowing connector cover 33, as shown in FIG. 11 that conceals the electrical contacts when the lighting fixture 24 has been removed. The collar 28 may be opened by depressing the end of cover thereby allowing it to pop up. Likewise, the housing 14 fits over the power, control and protocol modules 16, 18, and 20, and may be removed, for example, by depressing spring like or "living hinge" connectors 32, as shown in FIGS. 1-4, 6, 8, and 9, on the power and control modules 16, 18 or by other means known in the art. The collar 28 of the removable lighting fixture 24 conceals the open connector cover when the lighting fixture 24 has been installed, as shown in FIGS. 8, 10 and 15. FIG. 9 is an example of one particular implementation of the mounting means. Not shown in FIG. 9 is a female terminal block or receptacle that would preferably be positioned orthogonally to the PCB to allow the extended and exposed portion of flexible or rigid tubing to mate and terminate electrically and mechanically.

In an embodiment, the housing 14 also contains the controls 26 for the light fixture operation, as shown in FIGS. 1, 2, 8-11, and 14-16. The control 26 also provides for an optional true "air-gap" off to the lighting fixture 24 and light head 12 and source 25. Alternatively, the controls can also be installed in the head of the light fixture 24. In an embodiment, the electrical connections are provided by pin contacts 34 mounted in the lighting fixture 24 and socket type contacts 30 mounted in the receptacle, as shown in FIGS. 12-14 and 16.

In an embodiment, the quick disconnect module changes the primary way in which the lighting fixture 24 is held in place. The new design uses a two pin bayonet-style attachment 34. This allows secure mounting of the light fixture 24 while maintaining the quick-disconnect requirement. Using pin and socket contacts 24, 30 to make the electrical connections increases the reliability of those connections through proven technology. This style of contact can also be shrouded so that the contacts themselves are shielded from damage and inadvertent shock hazards. The invention also ties the visual, ergonomic and functional design elements together with the lighting fixture 24 head design into one homogeneous unit.

The approximate size of the receptacle 30 is 2"×3". The collar 28 is approximately 1.5" in diameter and is shaped for ergonomic operation and concealment of the open connector cover when the lighting fixture 24 has been installed. The collar 28 may be free to rotate about the end of the lighting fixture 24, or it may be rigidly coupled.

When in operation, the housing 14 is positioned either within or on a suitable piece of furniture such as a cabinet or a table. It may also be located remotely and not be assessable or visible to the passenger and a wiring harness can be used to connect the housing 14 to the lighting unit. The housing 14 may be within the furniture in any suitable way a user desires. For example, the housing 14 may be positioned on top of, flushed mounted, or completely enclosed within the furniture. Once located, the power control module 16 is electrically connected to a vehicle or building's power source in any manner known in the art. For example, in an embodiment, the power control module 16 contains electrical drive circuitry that converts aircraft power (example 28 VDC, 12 VDC) to a voltage and current used to drive the electronics in the control module, the protocol module and the lighting modules and is electrically connected to an aircraft's electrical power system in a manner known in the art, thereby providing the power necessary to light the fixture.

The control module 18 houses electrical and electronic circuitry including a microcontroller, LED dimmer and driver and circuitry, analog and digital control circuitry and optionally a communications transceiver and UARTs and is electrically connected to both the protocol module 20 and the power module 16, as shown in FIG. 5. This allows the control module 18 to receive a power boost from the power module 16 as it implements and controls the commands received from the protocol module 20. Although the control module 18 is capable of supplying limited power to the lighting fixture 24, the power boost received from the power module 16 allows the microprocessor(s) within the control module 18 to more thoroughly control and implement the commands from the protocol module 20.

The protocol module 20 houses electrical and electronic circuitry including a communications transceiver for use with control protocols such as CANBUS and a UART or other means to buffer signals and optionally a microcontroller and is electrically connected in a manner known to those of skill in the art with, for example, an RS485 physical layer with proprietary or open protocol cabin management system within an aircraft. Furthermore, the protocol module 20 may be connected to a device that controls light intensity such as a rheostat switch or an on/off power switch.

During operations, power supplied to the light fixture 24 from the control module 18 is amplified by the power module 16 which receives its power from the power system of a vehicle or other power generator. In an embodiment, for example, the power source may receive power from an aircraft power system. It may also, however, receive power from the power system of a recreational vehicle or a bus.

The control module 18 receives input from the protocol module 20 which is electrically connected to a control system such as an aircraft cabin management system, a rheostat control, or an on/off switch. The protocol module 20 transmits a signal to the control module 18 which in turn adjusts, for example, the intensity of the light source in the light fixture 24, in order to comply with the signal received from the protocol module 20. In some cases the protocol module 20 and control module 18 are combined into one module and perform both functions.

The light source 25 is emitted from the light fixture 24, which is electrically connected to the power module 16 and the control module 18 through the PCB interface 22 can also be turned on and off locally through the use of an on/off switch 26 mounted within the housing 14.

All references, including publications, patent applications, and patents, cited herein are hereby incorporated by reference to the same extent as if each reference were individually and specifically indicated to be incorporated by reference and were set forth in its entirety he rein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A lighting system comprised of:

a housing including an aperture disposed in a top surface of the housing, the housing at least partially surrounding a power module and a control module;

a protocol module electrically connected to the control module;

a PCB interface electrically connecting the power module to the control module, the PCB interface disposed in the aperture between a collar of a lighting fixture and the control module, the PCB interface oriented substantially parallel to a plane that defines the top surface of the housing;

a first connector electrically connected to the PCB interface and slidably receiving a mating second connector; and a light fixture comprising:

a flexible shaft having a first end and a second end, a collar radially surrounding the second end of the shaft and the second connector;

the second connector attaching the light fixture to the PCB interface when the second connector is slidably received by the first connector; and a light source attached to the first end of the shaft and distal to the housing.

2. The lighting system of claim 1, wherein the collar hides the PCB interface from view through the aperture.

3. The lighting system of claim 1, wherein the collar is disposed on the PCB interface and hides the first and second connectors from view through the aperture.

4. The lighting system of claim 1, further comprising a head containing the light source, wherein the head is orientated to cause light from the light source to radiate substantially downward toward the plane defining the top surface of the housing.

5. The lighting system of claim 1, wherein the light fixture is a flexible reading lamp.

6. The lighting system of claim 1, wherein the power module, control module and protocol module are combined into one module.

7. The lighting system of claim 1, wherein the power module, control module, protocol module and PCB interface are combined into one module.

8. The lighting system of claim 1 further comprising a self stowing cover covering the aperture.

9. The lighting system of claim 1, wherein the second connector is a two pin bayonet connector.

* * * * *